US008210924B2

(12) United States Patent
Hsu

(10) Patent No.: US 8,210,924 B2
(45) Date of Patent: Jul. 3, 2012

(54) DICE WITH RFID TAGS AND DICE RECOGNIZING SYSTEM FOR RECOGNIZING DICE WITH RFID TAGS

(76) Inventor: Tien-Shu Hsu, Taichung (TW)

( * ) Notice: Subject to any disclaimer, the term of this patent is extended or adjusted under 35 U.S.C. 154(b) by 104 days.

(21) Appl. No.: 12/826,684

(22) Filed: Jun. 30, 2010

(65) Prior Publication Data

US 2012/0004023 A1 Jan. 5, 2012

(51) Int. Cl.

| | |
|---|---|
| ***G06F 17/00*** | (2006.01) |
| ***G06F 19/00*** | (2006.01) |
| ***A63F 9/24*** | (2006.01) |
| ***A63F 13/00*** | (2006.01) |

(52) U.S. Cl. ..... 463/22; 273/146

(58) Field of Classification Search ..... 463/22; 273/146

See application file for complete search history.

(56) References Cited

U.S. PATENT DOCUMENTS

| | | | | |
|---|---|---|---|---|
| 2,693,962 | A * | 11/1954 | Stevens | 273/145 D |
| 3,350,098 | A * | 10/1967 | Cromp et al. | 273/145 CA |
| 3,459,427 | A * | 8/1969 | Rhodes | 463/22 |
| 4,892,311 | A * | 1/1990 | Zaitsu | 273/145 D |
| 5,651,548 | A * | 7/1997 | French et al. | 463/25 |
| 5,694,045 | A * | 12/1997 | Ikeda et al. | 324/652 |
| 5,707,061 | A * | 1/1998 | Ikeda et al. | 273/145 R |
| 5,751,570 | A * | 5/1998 | Stobbe et al. | 700/11 |
| 6,220,594 | B1 * | 4/2001 | Peng | 273/146 |
| 6,331,145 | B1 * | 12/2001 | Sity et al. | 463/22 |
| 6,394,903 | B1 * | 5/2002 | Lam | 463/22 |
| 6,609,710 | B1 * | 8/2003 | Order | 273/148 R |
| 6,834,855 | B2 * | 12/2004 | Mancuso | 273/146 |
| 2004/0036213 | A1 * | 2/2004 | Lindsey | 273/146 |
| 2005/0137008 | A1 * | 6/2005 | Itagaki et al. | 463/22 |
| 2005/0215312 | A1 * | 9/2005 | Tresser et al. | 463/22 |
| 2005/0221886 | A1 * | 10/2005 | Itagaki et al. | 463/22 |
| 2006/0187051 | A1 * | 8/2006 | Wu et al. | 340/572.7 |
| 2006/0246403 | A1 * | 11/2006 | Monpouet et al. | 434/128 |
| 2007/0035399 | A1 * | 2/2007 | Hecht et al. | 340/572.1 |
| 2009/0104976 | A1 * | 4/2009 | Ouwerkerk et al. | 463/22 |
| 2010/0032896 | A1 * | 2/2010 | Berlec et al. | 273/146 |
| 2010/0059933 | A1 * | 3/2010 | Sasaki | 273/145 R |
| 2010/0062832 | A1 * | 3/2010 | Yoshihara | 463/22 |
| 2010/0120512 | A1 * | 5/2010 | Darling | 463/22 |
| 2010/0124964 | A1 * | 5/2010 | Kishi | 463/16 |
| 2011/0018194 | A1 * | 1/2011 | Nicely et al. | 273/145 CA |

FOREIGN PATENT DOCUMENTS

JP 02249574 A * 10/1990

* cited by examiner

*Primary Examiner* — Milap Shah
(74) *Attorney, Agent, or Firm* — WPAT, P.C.; Anthony King

(57) ABSTRACT

This invention discloses a dice with RFID (radio-frequency identification) tags and a dice recognizing system for recognizing dice with RFID tags. The dice with RFID tags comprises at least a dice body and a plurality of RFID tags. The dice body is a regular polyhedron with at least six faces, and at least a pip is disposed on each face of the dice. The plurality of RFID tags are disposed on any two opposite faces of the dice body, respectively. One of the two opposite faces is disposed with at least one RFID tag, and the other one of the opposite faces is disposed with the plurality of RFID tags. The projection spots of all the plurality of RFID tags on the face with the RFID tag can be interconnected into a polygon.

2 Claims, 13 Drawing Sheets

DICE WITH RFID TAGS AND DICE RECOGNIZING SYSTEM FOR RECOGNIZING DICE WITH RFID TAGS

FIELD OF THE INVENTION

The exemplary embodiment(s) of the present invention relates to RFID tags and a dice recognizing system. More specifically, the exemplary embodiment(s) of the present invention relates to a dice with RFID tags and a dice recognizing system for recognizing dice with RFID tags, which can unartificially determine the results and state of dice in real-time.

BACKGROUND OF THE INVENTION

A dice game is a competition or game based on adding points determined by random throws of a plurality of dice. The dice game is generally played by placing a plurality of dice in a dice cup and manually shaking the dice cup. When the dice cup and the dice come to rest, the dice cup is opened and the points of the dice are compared to determine the result of the competition or game. The "points" are customarily referred to the numbers of the pips showing on the upward faces of the dice after they come to rest. Another dice game is played by manually throwing a plurality of dice on an open table surface or in a container. When the dice come to rest on the table surface or in the container, the dice tags are artificially judged to determine the result of the competition or game. However, no matter what kind of dice game, they all require shaking (throwing) dice and determining the result in an artificial manner. It is easy to cause cheats in such dice games so that they cannot be completely fair and impartial.

In order to make dice game fair and impartial, techniques for new dice games have been developed on game machines so that a player can simulate throwing real dice on the game machine and the result can be determined by the game machine. However, the interest in a dice game mainly on throwing, real dice and the uncertainty in waiting for rolling dice. The excitement and suspense cannot be substituted by computer technology.

In order to keep both the interest in a dice game and the fair and impartial result of a dice game, there is indeed a need to provide a system which combines real dice with machine interpretation of the dice tags.

In techniques for machine interpretation or information recognition of articles, radio frequency identification (RFID) technology is widely applied, also called electronic tag, which is a communication technology. There is no need to make mechanical or optical contact between an RFID system and a specific object. It is only necessary to pre-install an RFID tag in the specific object such that the RFID system can recognize and read/write the correlated data of the specific object via radio signals.

RFID tags are divided into passive type, semi-active type and active type. RFID tags can store a certain amount of information, so they are commonly used for recognizing and recording commodities or personnel. Passive RFID tags have no need to be connected to a power source and have the advantages of small size and low price, so they are the most widely used RFID tags now.

In view of various problems of the prior art, the inventors, based on previous experience, propose a dice with RFID tags and a dice recognizing system for recognizing dice with RFID tags to improve the above drawbacks.

SUMMARY OF THE INVENTION

In view of the above-mentioned problems of the prior art, an object of the present invention is to provide a dice with RFID tags and a dice recognizing system for recognizing dice with RFID tags, which solve the problem that it is easy to cause unfair results because dice are artificially shaken (thrown) and the results are artificially determined, so as to keep the interest in throwing dice.

According to an object of the present invention, there is provided a dice with RFID tags, comprising a dice body and a plurality of RFID tags. The dice body is a regular cube with six faces. Each two opposite faces of the six faces are parallel to each other. At least one pip is disposed on each face. In addition, the RFID tags are disposed on any two opposite faces. One of the two opposite faces is disposed with at least one RFID tag, and the other one of the opposite faces is disposed with a plurality of RFID tags.

In the dice with RFID tags according to the present invention, all the RFID tags are disposed on the pips, respectively, and the RFID tags can be interconnected into a polygon when seeing through all the faces with the RFID tags.

According to an object of the present invention, there is further provided a dice recognizing system for recognizing dice with RFID tags, comprising at least one dice body, a plurality of RFID tags, at least one RFID reader and at least one processing module. Each of the dice bodies is a regular cube with six faces. Each two opposite faces of the six faces are parallel to each other. At least one pip is disposed on each face. In addition, the RFID tags are disposed on any two opposite faces. One of the two opposite faces is disposed with at least one RFID tag, and the other one of the opposite faces is disposed with a plurality of RFID tags. Moreover, the RFID reader has an antenna and is dis posed on a platform. The dice body rolls or rests on the platform. The height of an induction field formed by the RFID reader and the antenna is less than half the height of the dice body. When the dice body rests on the platform, the RFID reader emits an electromagnetic wave to drive the RFID tags to emit the first signal. The antenna receives the first signal emitted by the driven RFID tags. Then, the RFID reader emits the second signal to the processing module. The processing module records and analyzes the second signal after receiving the second signal.

In the dice recognizing system for recognizing dice with RFID tags according to the present invention, all the RFID tag are disposed on the pips, respectively, and the RFID tags of all the dice can be interconnected into a polygon when seeing through all the faces of all the dice bodies with the RFID tags.

As described above, the dice with RFID tags and the dice recognizing system for recognizing dice with RFID tags according to the present invention may have one or more of the following advantages:

(1) According to the dice with RFID tags and the dice recognizing system for recognizing dice with RFID tags, the RFID reader can directly read signals from all the RFID tags and transmit them to the processing module for determination. This process is performed without artificial determination and thus makes the result of throwing dice fair and impartial.

(2) According to the dice with RFID tags and the dice recognizing system for recognizing dice with RFID tags, a result of throwing dice is determined mechanically, which is not by a simulation of a game machine. The dice and the system are used to determine a result of throwing real dice, so as to keep the original interest in throwing dice.

(3) In the dice with RFID tags and the dice recognizing system for recognizing dice with RFID tags, passive RFID tags are used as targets for recognition purposes. Passive RFID tags have the advantages of small size and low price and have no need to be connected to an additional power source.

Thus, this invention is easily implemented without changing an original manner or habit of using dice and has no influence on the original appearance of dice.

With these and other objects, advantages, and features of the invention that may become hereinafter apparent, the nature of the invention may be more clearly understood by reference to the detailed description of the invention, the embodiments and to the several drawings herein.

DETAILED DESCRIPTION OF THE PREFERRED EMBODIMENTS

Figure 1:
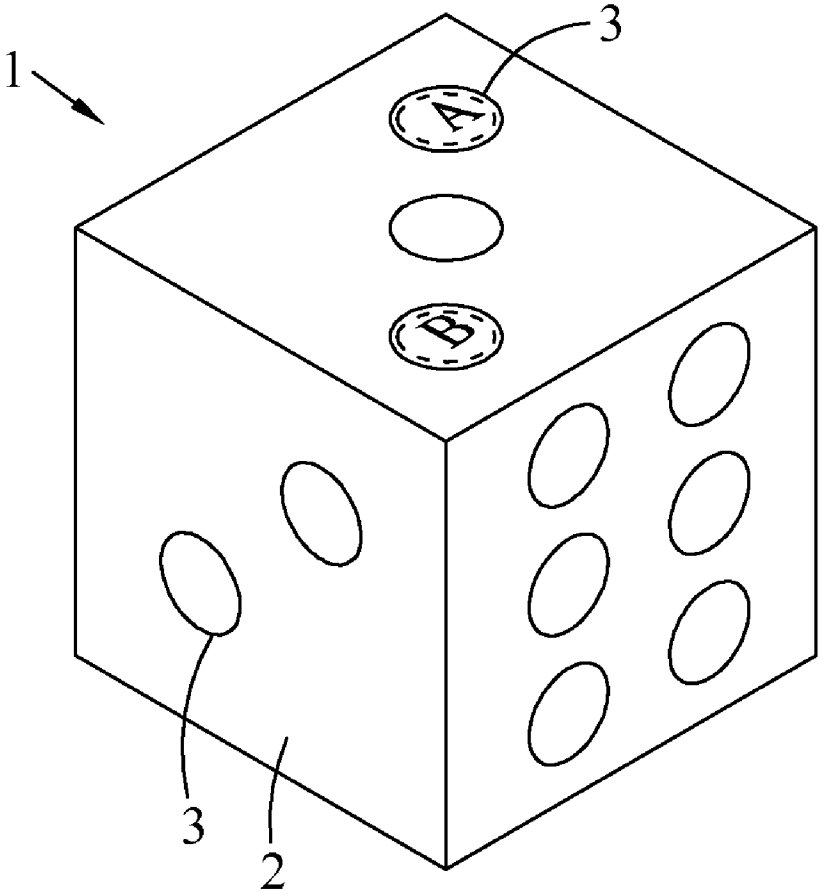
FIG. 1 is a distribution diagram I illustrating tag positions of the first embodiment of a dice with RFID tags according to the present invention.
Figure 2:
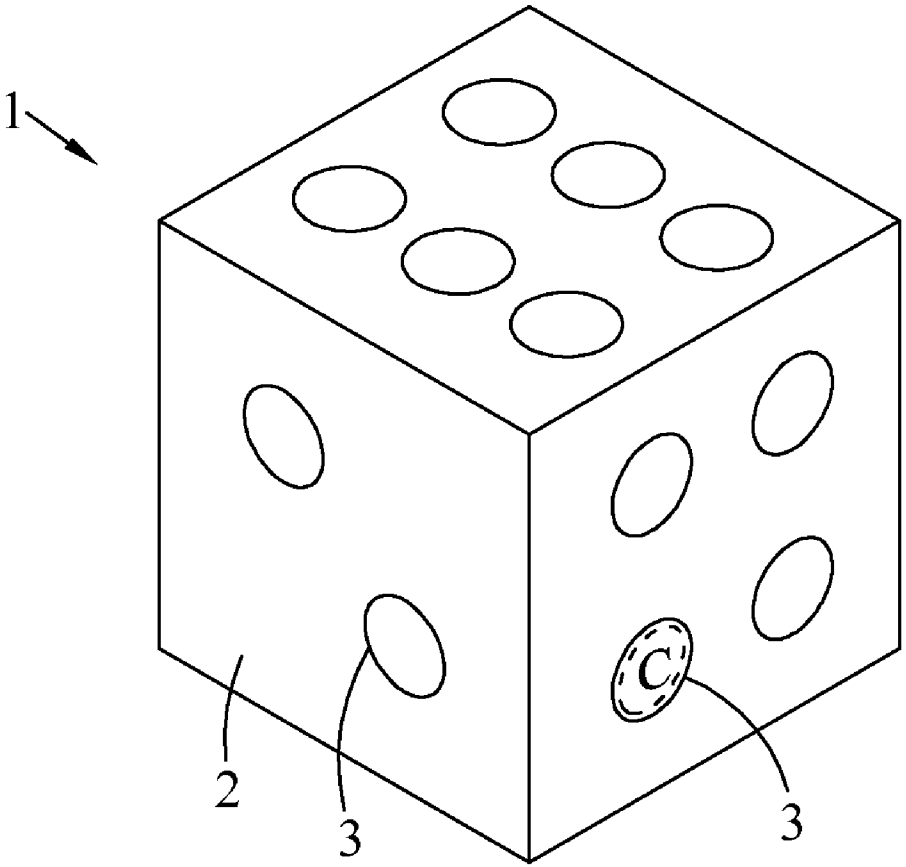
FIG. 2 is a distribution diagram II illustrating tag positions of the second embodiment of a dice with RFID tags according to the present invention.
Figure 3:
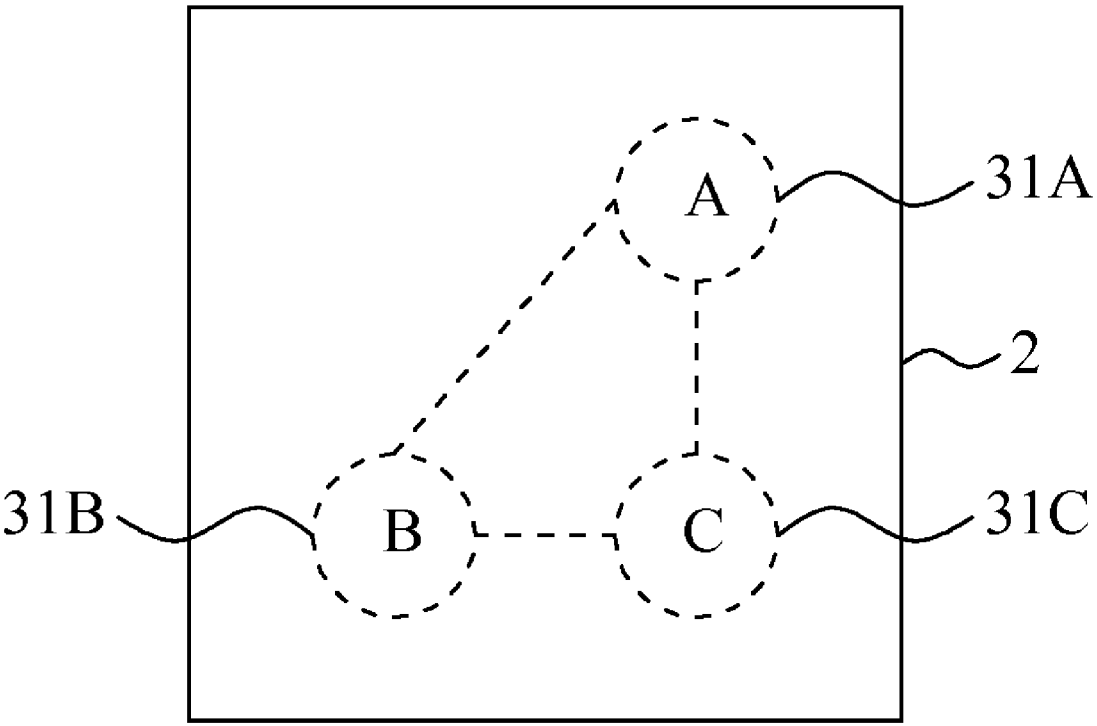
FIG. 3 is a projection view of tag positions of the first embodiment of a dice with RFID tags according to the present invention.

Referring to FIGS. 1 to 3, there are illustrated distribution diagrams I and II of and a projection view of tag positions of the first embodiment of a dice with RFID tags according to the present invention. In these figures, the dice body 1 is a regular cube with six square faces 2, which are numbered sequentially from one, two to six by patterns of dots called pips 3. The numbers of the pips 3 on each pair of parallel faces 2 always add up to the total seven.

In the first embodiment, the dice body 1 is disposed thereon with three RFID tags: a tag A, a tag B and a tag C, respectively. Each RFID tag stores different recognition data for distinguishing different tags. The tag A and the tag B are respectively disposed on the face 2 with three pips 3 and respectively disposed on the pips 3 in two corners of this face (as illustrated in FIG. 1). The tag C is disposed on the face with four pips 3 and disposed on one of the pips 3 (as illustrated in FIG. 2). In this embodiment, the disposed tag A, tag B and tag C are projected onto one of the faces 2 with the RFID tags. Then, the tag A, the tag B and the tag C become 31A, 31B and 31C and can be interconnected into an equilateral triangle after seeing through the two faces with these tags (as illustrated in FIG. 3).

Figure 4:
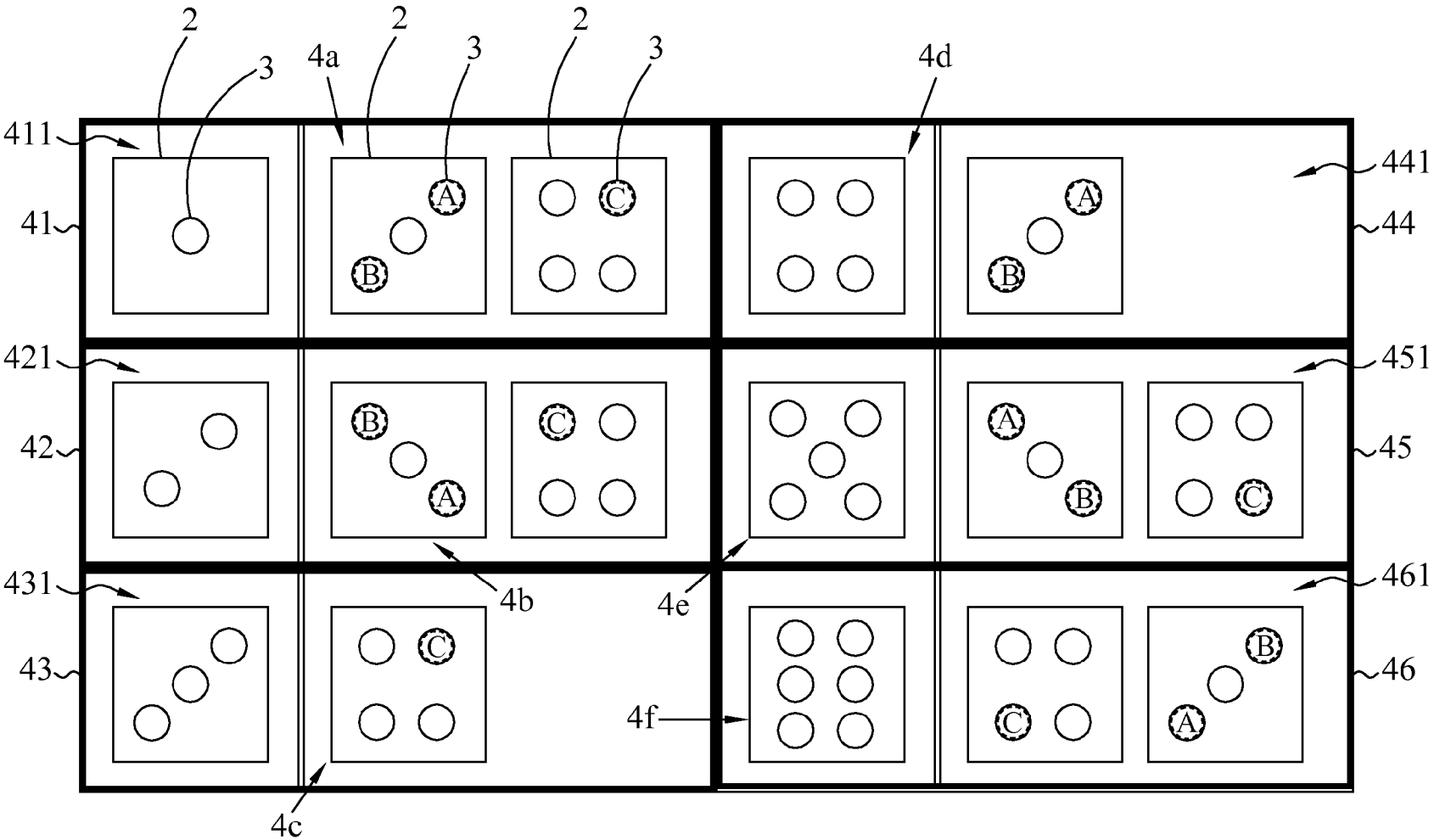
FIG. 4 is a schematic view of combinations of pips and tags of a dice according to the first embodiment of the present invention.

Referring to FIG. 4, there is illustrated a schematic view of combinations of pips and tags of a dice according to the first embodiment of the present invention. There are totally six patterns of pips on the six faces 2 of the dice body 1, respectively listed on the left sides of columns 41, 42 . . . 46 for illustrating various combinations in FIG. 4. When top views of the patterns of pips 4*a*, 4*b* . . . 4*f* on the dice body 1 are different, the corresponding tag positions are different. Side views or bottom views of various patterns of dice pip combinations 411, 421 . . . 461 are respectively shown on the right sides of columns 41, 42 . . . 46 for illustrating various combinations in FIG. 4.

When the number of pips on the dice is one, the tag A and the tag C on the dice body 1 are near the top of the dice body 1 and the tag B is near the bottom of the dice body 1 (as illustrated by 411 in FIG. 4). Different numbers of pips 3 give different combinations of RFID tags, so as to distinguish various patterns of pips 4*a*, 4*b* . . . 4*f* on the dice.

When a top view of the dice body 1 shows a pattern of three or four pips 3 (as illustrated by 4*c* or 4*d* in FIG. 4), there are no tags on the sides of the dice. Therefore, the tags are represented by the bottom views 431, 441 of the dice body 1, and the others are side views.

Figure 5:
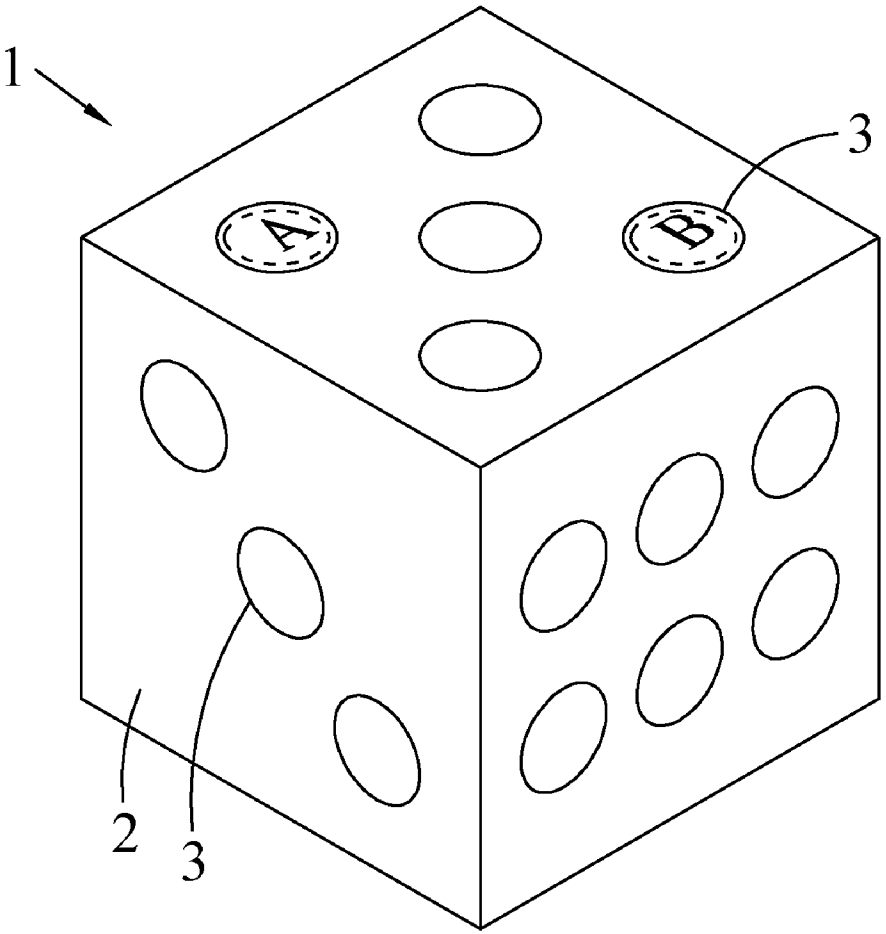
FIG. 5 is a distribution diagram I illustrating tag positions of the second embodiment of a dice with RFID tags according to the present invention.
Figure 6:
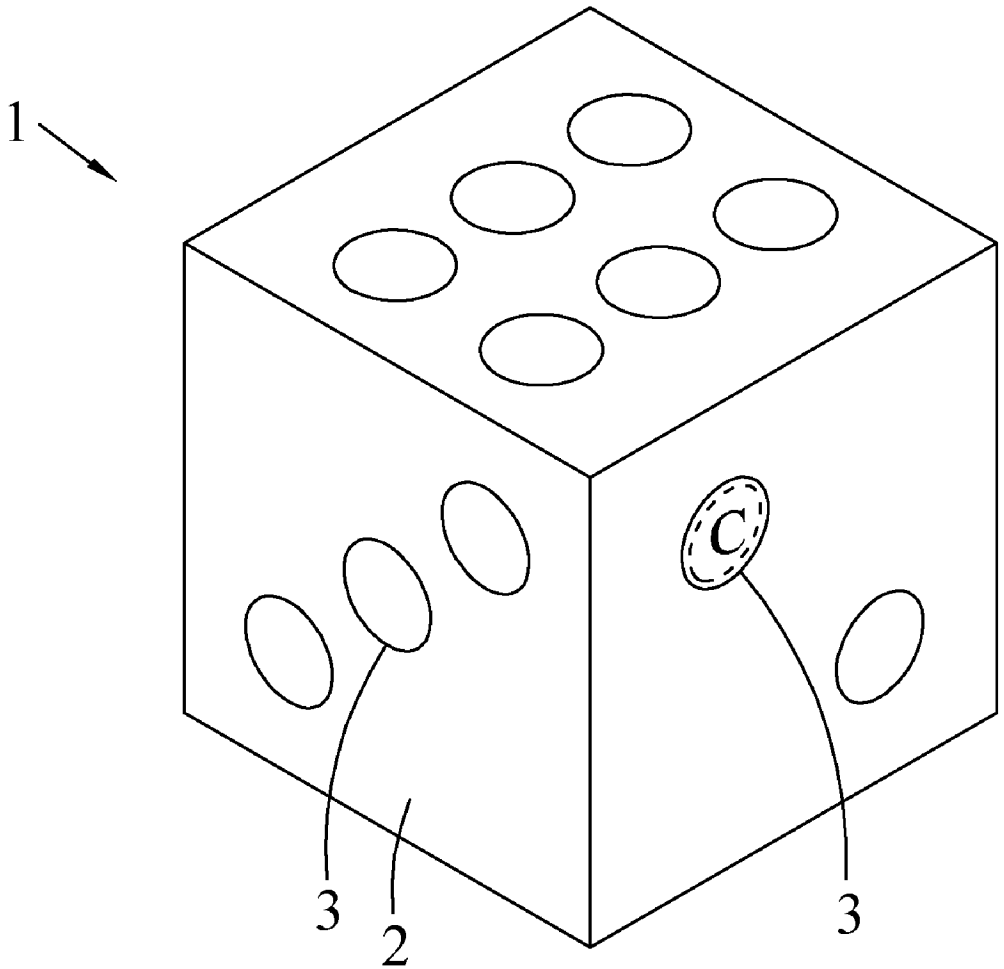
FIG. 6 is a distribution diagram II illustrating tag positions of the second embodiment of a dice with RFID tags according to the present invention.
Figure 7:
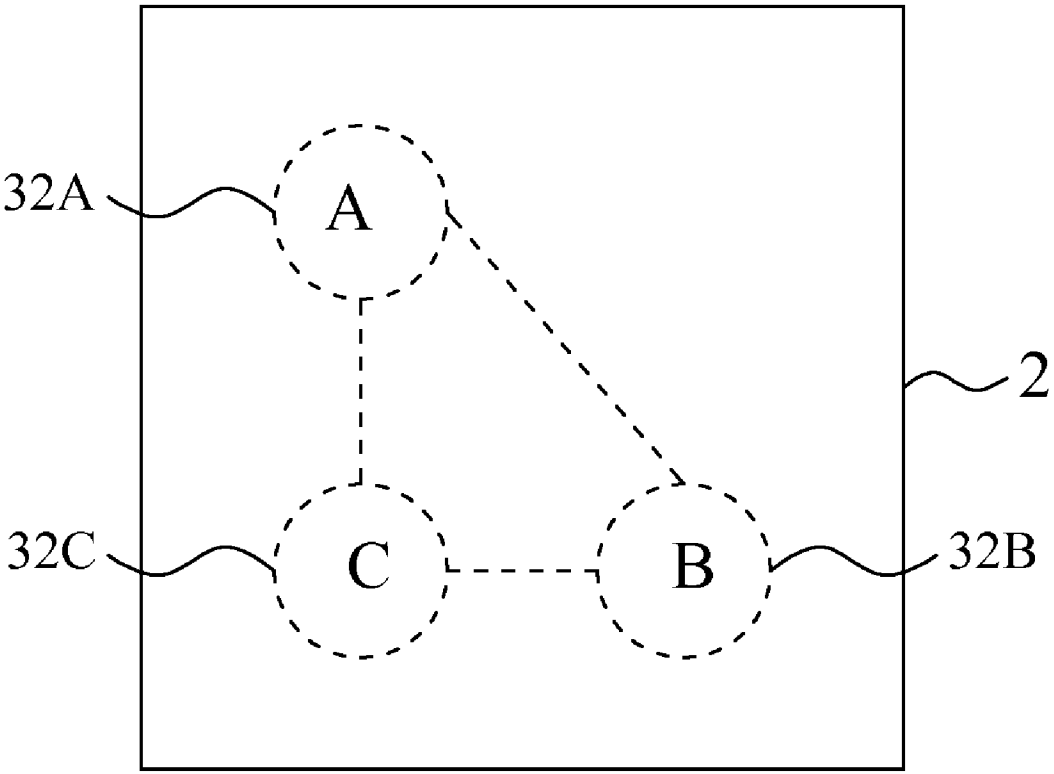
FIG. 7 is a projection view of tag positions of the second embodiment of a dice with RFID tags according to the present invention.

Referring to FIGS. 5 to 7, FIGS. 5 to 6 are distribution diagrams illustrating tag positions of the second embodiment of a dice with RFID tags according to the present invention. FIG. 7 is a projection view of tag positions of the second embodiment of a dice with RFID tags according to the present invention. The difference between the second embodiment and the first embodiment mainly lies in the positions of the tag A, the tag B and the tag C. In this embodiment, the tag A and the tag B are disposed on the face with five pips 3 and respectively disposed on the pips 3 in two corners of the four corners (as illustrated in FIG. 5). The tag C is disposed on the face parallel and opposite to the face 2 with the tag A and the tag B. That is, the tag C is disposed on the face with two pips 3 and disposed on one of the pips 3 (as illustrated in FIG. 6). The tag A, the tag B and the tag C become 32A, 32B and 32C and can be interconnected into a triangle after seeing through the two faces with these tags (as illustrated in FIG. 7).

Figure 8:
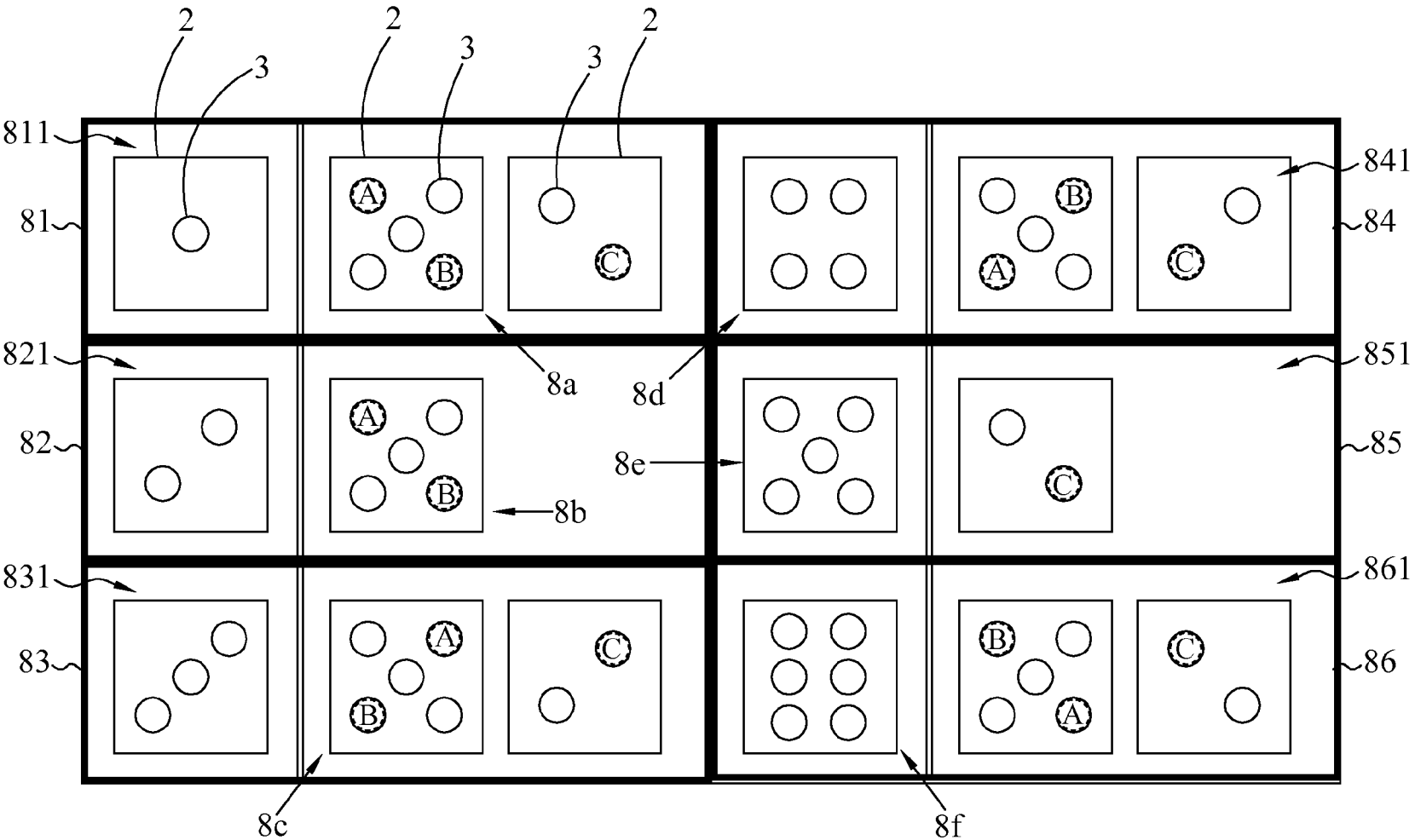
FIG. 8 is a schematic view of combinations of pips and tags of a dice according to the second embodiment of the present invention.

Referring to FIG. 8, there is illustrated a schematic view of combinations of pips and tags of a dice according to the second embodiment of the present invention. This figure shows six patterns of pips 8*a*, 8*b* . . . 8*f* on the dice body 1, respectively, and the pip combinations 811, 821 . . . 861 of the corresponding tag positions in the second embodiment. Various combinations are respectively listed in columns 81, 82 . . . 86. When a top view of the dice body 1 shows a pattern of two or five pips 3 (as illustrated by 8*b* or 8*e* in FIG. 8), there are no tags on the sides of the dice. Therefore, the tags are represented by the bottom views 821, 851 of the dice body 1, and the others are side views.

Figure 9:
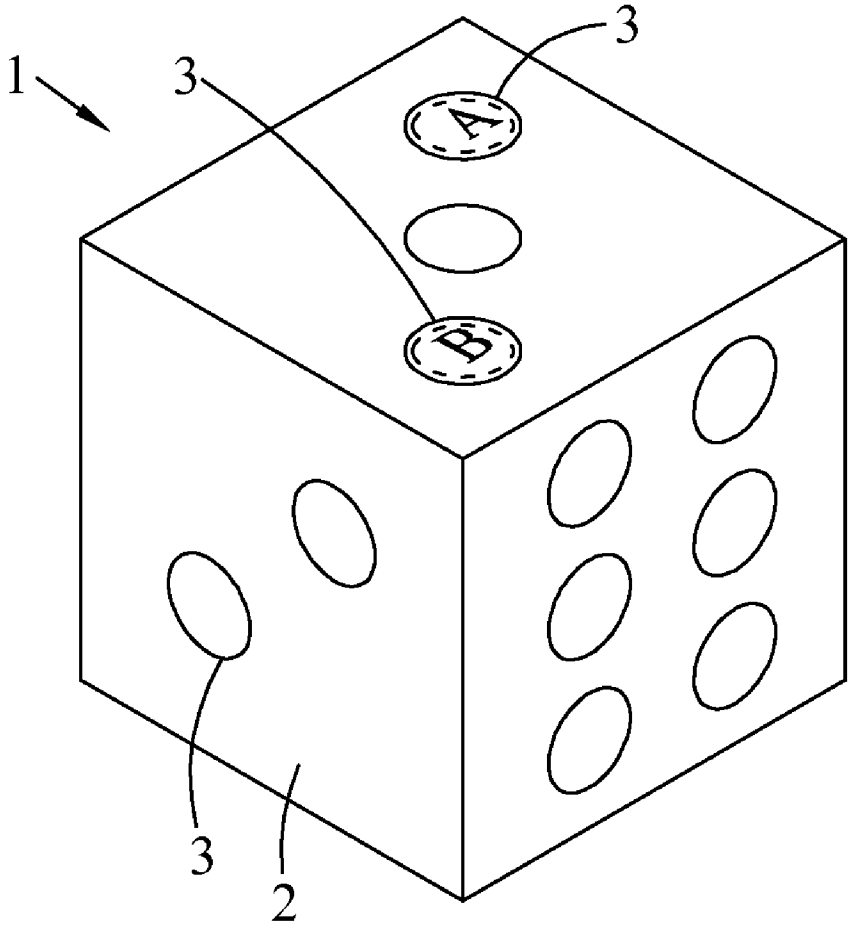
FIG. 9 is a distribution diagram I illustrating tag positions of the third embodiment of a dice with RFID tags according to the present invention.
Figure 10:
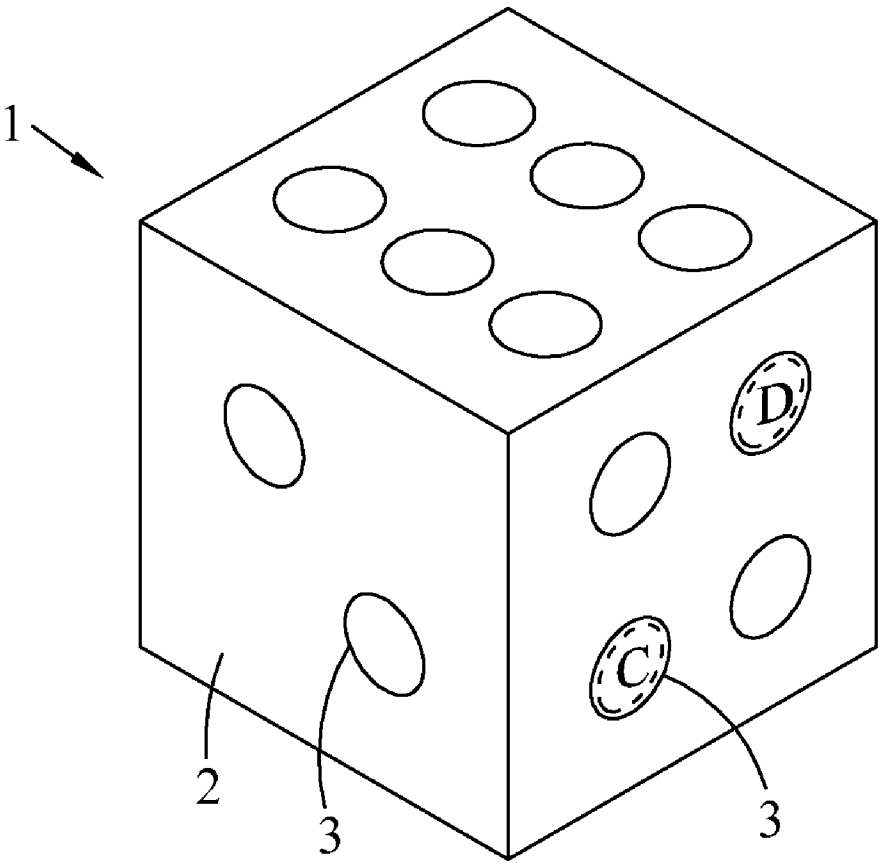
FIG. 10 is a distribution diagram II illustrating tag positions of the third embodiment of a dice with RFID tags according to the present invention.
Figure 11:
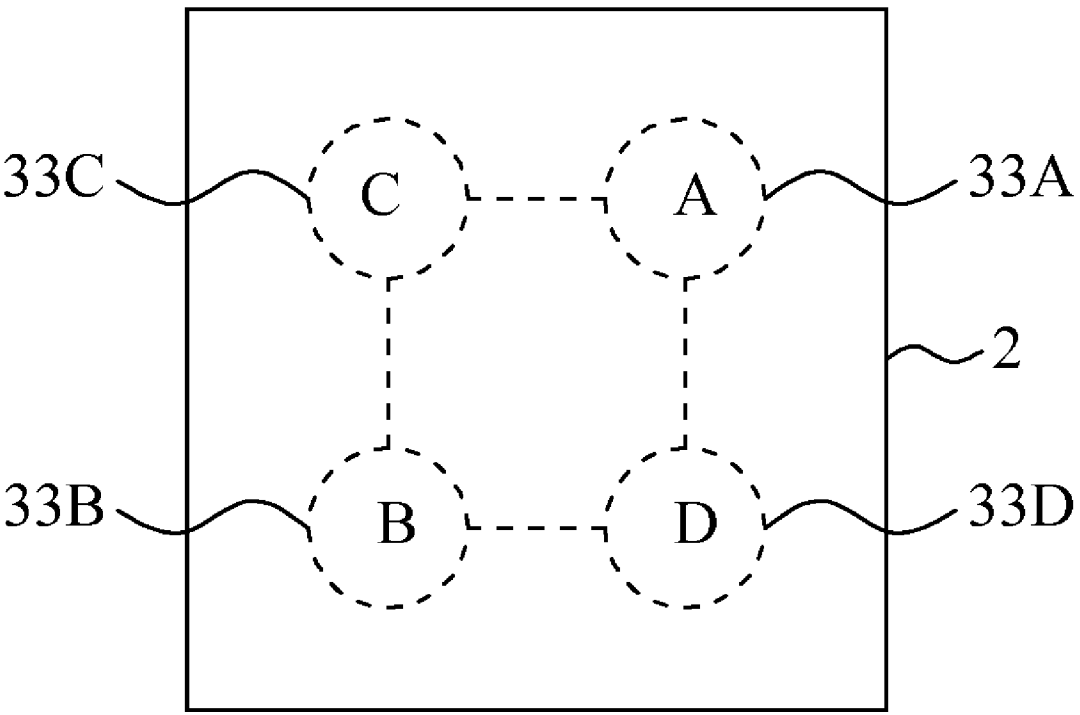
FIG. 11 is a projection view of tag positions of the third embodiment of a dice with RFID tags according to the present invention.
Figure 12:
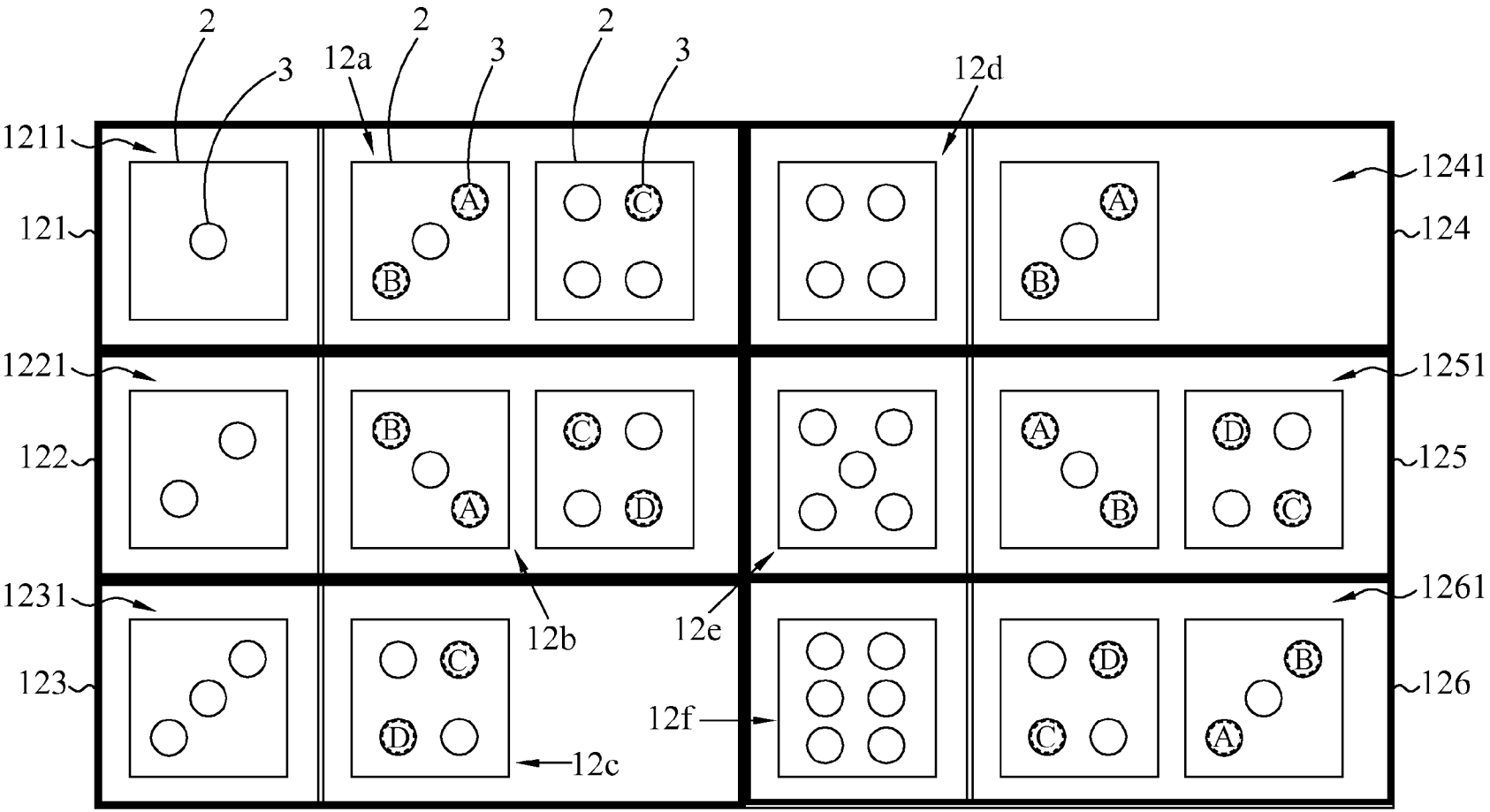
FIG. 12 is a schematic view of combinations of pips and tags of a dice according to the third embodiment of the present invention.

Referring to FIGS. 9 to 12, FIGS. 9 to 10 are distribution diagrams illustrating tag positions of the third embodiment of a dice with RFID tags according to the present invention. FIG. 11 is a projection view of tag positions of the third embodiment of a dice with RFID tags according to the present invention. According to the third embodiment, two RFID tags are disposed on each of one pair of two opposite faces of the dice body 1. In this embodiment, the tag A, the tag B, the tag C and the tag D represent. RFID tags at different positions, respectively, and the positions are respectively illustrated in FIGS. 9 and 10. FIG. 12 shows six patterns of pips 12*a*, 12*b* . . . 12*f* on the dice body 1 and the pip combinations 1211, 1221 . . . 1261 of the corresponding tag positions in the third embodiment. Various combinations are respectively listed in columns 121, 122 . . . 126. The tag A, the tag B, the tag C and the tag D become 33A, 33B, 32C and 32D and can be interconnected into a quadrilateral after seeing through the two faces with these tags (as illustrated in FIG. 11). When a top view of the dice body 1 shows a pattern of three or four pips 3 (as illustrated by 12*c* or 12*d* in FIG. 12), there are no tags on the sides of the dice body 1. Therefore, the tags are represented by the bottom views 1231, 1241 of the dice body 1, and the others are side views.

Figure 13:
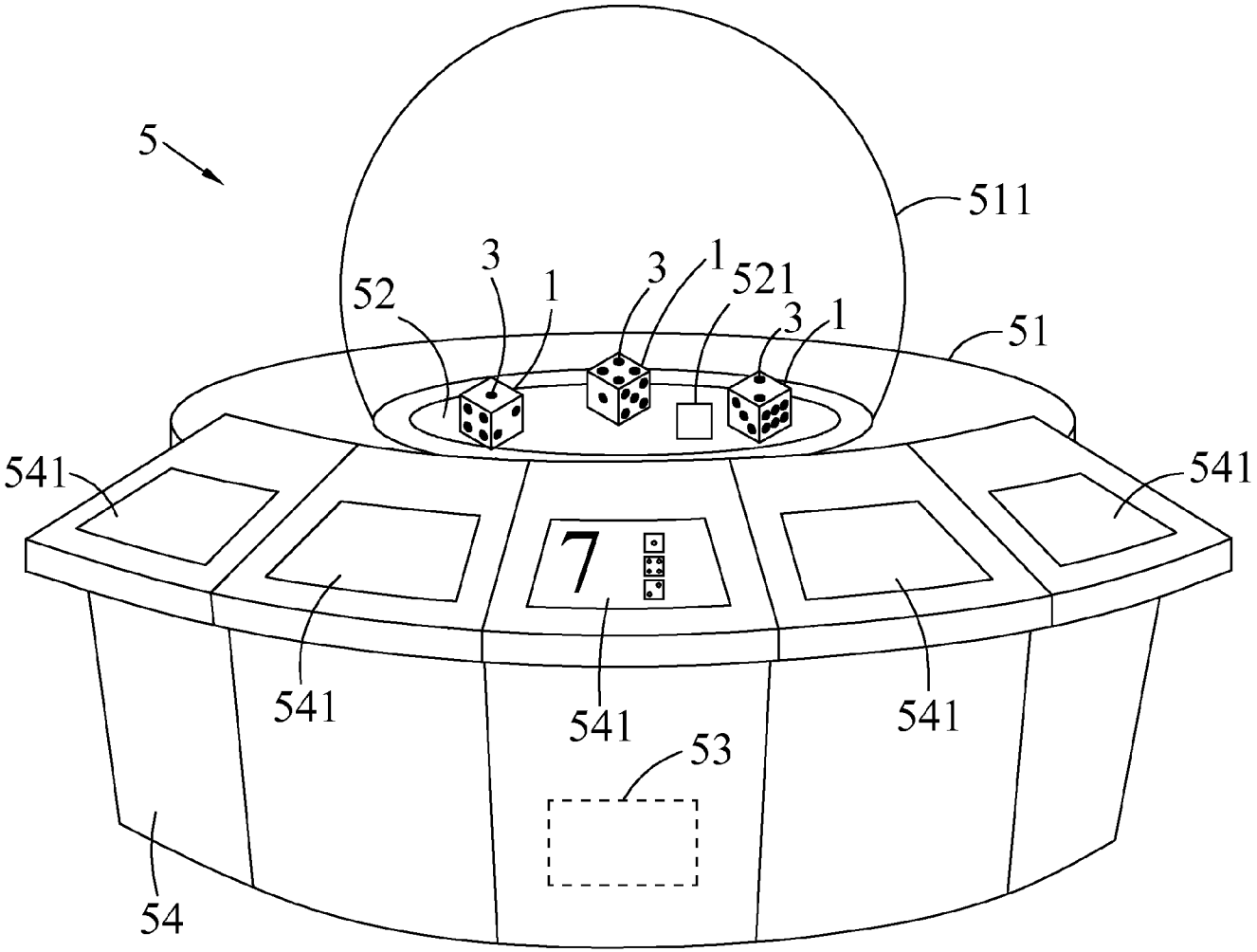
FIG. 13 is a schematic view of the first embodiment of a dice recognizing system for recognizing dice with RFID tags according to the present invention.

Referring to FIG. 13, there is illustrated a schematic view of a first embodiment of a dice recognizing system for recognizing dice with RFID tags according to the present invention. In this embodiment, the dice recognizing system is applied to a game machine 5. The game machine 5 has a platform 51 and a console 54. The platform 51 is covered thereon with a transparent cover 511, and the area of the platform 51 covered by the transparent cover 511 is disposed with at least one RFID reader 52. The RFID reader 52 further comprises an antenna 521. In this embodiment, it is exemplified, that an RFID reader 52 is disposed and has an antenna 521 and the platform 51 is a dice board, but the present invention is not limited thereto.

At least a dice body 1 is placed inside the transparent cover 511. In this embodiment, it is exemplified that three dice are placed, but the present invention is not limited thereto. The console 54 comprises a processing module 53 and a display screen 541. The height of an induction field (not illustrated) formed by the RFID reader 52 and the antenna 521 is less than half the height of the dice body 1.

When all the dice bodies 1 are thrown and then rest on the platform 51 within the area covered by the transparent cover 511, the RFID reader 52 emits wireless electromagnetic waves to drive the RFID tags on each dice body 1. Due to different distances from the tags on the dice bodies 1 to the RFID reader 52, some tags located nearer from the RFID reader 52 are activated to emit first signals, but some RFID tags located farther from the RFID reader 52 are not activated. Each RFID tag has its own unique recognition information. Relatively, the first signals emitted by the RFID tags when activated are different from each other in order to distinguish these tags.

The RFID reader 52 receives, through the antenna 521, the first signals emitted by the activated RFID tags. The results of the upper faces of dice bodies 1 can be obtained by different combinations of the first signals, so as to determine the number of pips that appear on the upper face of each dice body 1.

The tag positions of the first embodiment of a dice with RFID tags according to the present invention are exemplified as well as with reference to FIGS. 1 to 4. When the three dice bodies 1 all come to rest, the RFID reader 52 on the platform 51 drives the RFID tags on all the dice bodies 1 to send back the first signals. The combinations of the first signals are the tag B and the tag C, the tag A and the tag B, and the tag A and the tag C, respectively. The RFID reader 52 converts the combinations of the first signals into a second signal to be transmitted to processing module 53. The processing module 53 records and analyzes the second signal and drives the display screen 541 on the console 54 to display the calculated result.

In this embodiment, the combinations of the first signals transmitted from the dice bodies 1 to the RFID reader 52 are the tag B and the tag C, the tag A and the tag B, and the tag A and the tag C, respectively. That is, the numbers of pips on the upper faces of the dice bodies 1 are one, two and four, respectively. The RFID reader 52 further converts the combinations of the first signals into a second signal to be transmitted to processing module 53. The result that the numbers of pips on the upper faces of the dice bodies 1 are one, two and four can be received and then analyzed by the processing module 53 to drive the display screen 541 to display this result. The processing module 53 can further drive the display screen 541 to display that the sum of the numbers of pips on the upper faces of the dice bodies 1 is seven, but the present invention is not limited thereto.

Referring to FIGS. 9, 10 and 12, it can be seen from FIG. 12 that when the dice body 1 is disposed with four RFID tags, no matter what a pattern of pips on the dice body 1 is, there are always two RFID tags near the bottom of the dice body. Namely, the number of RFID tags near the RFID reader 52 of the system is two. By means of the characteristics of such combinations, it can be further recognized whether or not the dice body rests or its resting state is normal. When the number of tags recognized by the RFID reader 52 is not equal to two, it means that the dice is in an abnormal state or does not rest or is stacked on another. If one dice is stacked on another, the numbers of pips are not taken into account. The dice must be thrown again to make a more exact determination of the result of throwing dice.

The above description is illustrative only and is not to be considered limiting. Various modifications or changes can be made without departing from the spirit and scope of the invention. All such equivalent modifications and changes shall be included within the scope of the appended claims.

What is claimed is:

1. A dice recognizing system for recognizing dice with radio frequency identification (RFID) tags, comprising:

at least one dice body, each dice body being a regular cube with six faces, each two opposite faces of the six faces being parallel to each other, and at least one pip being disposed on each face;

a plurality of the RFID tags disposed on any single pair of two opposite faces of the at least one dice body, each of the RFID tags having unique recognition information, one of the two opposite faces being disposed with at least one of the RFID tags within one pip of the respective face, the other one of the two opposite faces being disposed with the remainder of the plurality of the RFID tags within one or more pips of the respective face, and wherein there are no RFID tags disposed on the other four faces;

at least one RFID reader disposed on a platform and having an antenna, the RFID reader emitting an electromagnetic wave to drive one or more of the plurality of RFID tags to emit one or more first signals, each first signal containing unique recognition information for one of the plurality of RFID tags, the antenna receiving the first signals emitted by the one or more RFID tags, the RFID reader emitting a second signal after the antenna receives the first signals; and at least one processing module receiving the second signal emitted by the RFID reader;

wherein:

the at least one dice body rolls and comes to rest on the platform;

the height of an induction field formed by the RFID reader and the antenna is less than half the height of the dice body;

when the dice body rests on the platform, the RFID reader emits the electromagnetic wave to drive one or more of the plurality of RFID tags resting within the height of the induction field to emit the first signals, such that the one or more RFID tags resting above the height of the induction field are not driven by the electromagnetic wave;

the antenna receives the first signals emitted by the one or more RFID tags driven by the electromagnetic wave;

the RFID reader emits the second signal to the processing module; and after receiving the second signal, the processing module records and analyzes the second signal to determine a number of pips which appear on an upper face of the at least one dice body resting on the platform, based on the first signals and a combination of the one or more RFID tags resting within the height of the induction field identified by their respective unique recognition information.

2. The dice recognizing system for recognizing dice with RFID tags as set forth in claim 1, wherein the plurality of RFID tags of all the dice can be interconnected into a polygon when seeing through all of the faces of all of the dice bodies with the RFID tags.

* * * * *